United States Patent [19]

Tucker

[11] Patent Number: 4,890,820

[45] Date of Patent: Jan. 2, 1990

[54] HEATING APPARATUS FOR A METALLIC STRAND

[75] Inventor: Robert J. Tucker, Stratford upon Avon, England

[73] Assignee: British Gas plc, London, England

[21] Appl. No.: 352,608

[22] Filed: May 15, 1989

Related U.S. Application Data

[63] Continuation of Ser. No. 125,332, Nov. 25, 1987, abandoned.

[30] Foreign Application Priority Data

Dec. 5, 1986 [GB] United Kingdom ..... 8629088

[51] Int. Cl.[4] ..... C21D 9/58

[52] U.S. Cl. ..... 266/107; 266/112; 266/120

[58] Field of Search ..... 266/107, 111, 112, 120; 148/15, 20, 153, 155, 156

[56] References Cited

U.S. PATENT DOCUMENTS

| | | | |
|---|---|---|---|
| 31,361 | 2/1861 | Washburn | 266/107 |
| 65,215 | 5/1867 | Hallas | 266/107 |
| 362,321 | 12/1920 | Johnson | 266/107 |

*Primary Examiner*—Robert McDowell

*Attorney, Agent, or Firm*—Larson and Taylor

[57] ABSTRACT

A method for heating a metallic strand 16 such as a wire or strip comprises passing the strand 16 along a metallic tube 4 which is filled with molten metal 13, the tube wall being heated by a furnace chamber 3 through which the tube 4 extends.

3 Claims, 1 Drawing Sheet

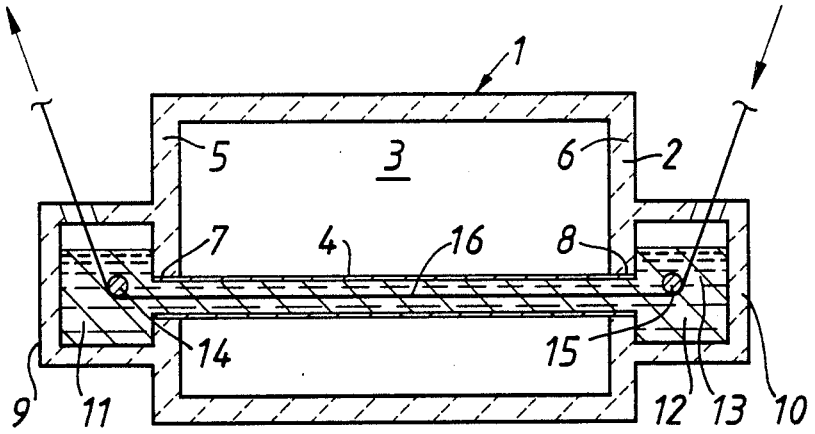
1
5
3
6
2
7
4
16
8
14
15
9
11
12
13
10

HEATING APPARATUS FOR A METALLIC STRAND

This application is a continuation of application Ser. No. 07/125,332 filed 11/25/87 abandoned.

The present invention relates to the heating of a metallic strand such as wire or strip by passing the strand through a molten metal which serves as the heat transfer medium.

The heat treating of a metallic strand such as wire or strip by passing the strand as a continuous length through a bath of molten metal serving as the heat transfer medium is well known. Unfortunately since its surface is open to the environment a molten metal bath can produce an unacceptably high concentration of the molten metal in the atmosphere surrounding the bath. In addition, molten metal baths require a large inventory of expensive molten metal and their generally large thermal capacity leads to a very low efficiency particularly during periods of low or intermittent production. Furthermore, the heating of these baths tends to be inefficiently carried out.

The main advantages of using molten metal as the heat transfer medium rather than say directly heating the strand by hot combustion gases or in a gaseous atmosphere is that the overall size of the equipment may be smaller than with direct heating and the surface quality of the strand is not impaired by its contact with oxidising gases or atmosphere as is frequently the case with direct heating.

It is therefore an object of the present invention to provide a method and apparatus for heating a metallic strand by using a molten metal as the heat transfer medium without the disadvantages inherent in using a molten metal bath.

According to one aspect of the present invention we provide a method for heating a metallic strand using molten metal as the heat transfer medium, the method comprising passing the strand along a tube which is filled with molten metal and which is heated externally.

According to another aspect of the present invention, we provide apparatus for heating a metallic strand using molten metal as the heat transfer medium, the apparatus comprising a tube through which, in use, the strand is passed and which, in use, is filled with molten metal, means for containing the molten metal in the tube and means for heating the external wall of the tube.

An embodiment of the invention will now be particularly described with reference to the drawing which shows a schematic side view in section of a suitable piece of apparatus for performing the method.

The apparatus comprises a furnace 1 having an insulated wall 2 defining a chamber 3 through which there extends horizontally a metallic tube 4.

Secured to the end walls 5, 6 of the furnace 1 adjacent to each end 7,8 of the tube 4 are wall extensions 9,10 forming reservoirs 11,12 for molten metal 13.

In use, the level of the molten metal 13 in the reservoirs 11,12 is such as to extend through and completely fill the metallic tube 4. Situated in each reservoir 11,12 is an idler roll 14,15 around which, in use, the strand 16 passes. The strand 16 may be supplied from a coil (not shown) as a continuous length to enter the reservoir 12, pass around the idler roll 15, and then through the tube 4. The strand 16 then leaves the reservoir 11 by way of the idler roll 14 before being recoiled. The furnace chamber 3 may contain a gas at elevated temperature to heat the wall of the tube 4 to maintain the metal in its molten state.

The tube can be of relatively small diameter and can be heated externally by means other than that described for instance by electrical or fuel-fired means. Because molten metals have such good thermal conductivity, the tube surface temperature can be maintained at close to the output temperature of the strand. The tube diameter can be so selected that the heat flux at its surface is within easily achievable levels by conventional heating techniques. The tube effectively increases the surface area for heat transfer to each strand without providing any significant additional thermal resistance. Because of the much reduced quantities of molten metal held in the process compared to molten metal baths, thermal response to changes in production demand or during start-up is improved leading to greater overall efficiency.

While not shown several tubes could be installed in any particular furnace. The tube(s) could be straight as shown or slightly U shaped.

The tube or tubes could be heated by any of the following techniques in addition to that described:

(i) Impingement or tangential firing of high velocity combustion products from oil or gas burners positioned around the external tube surface to achieve high rates of convective heating, (ii) Use of low thermal inertia radiant gas burners positioned around individual or multiple tube assemblies.

(iii) Use of conventional firing techniques or those based on (i) and (ii) above, but with recovery of the flue gas heat by recuperators or regenerators.

(iv) By immersing the tubes within a fuel fired fluidised bed, and (v) Use of electrical methods such as indirect resistance or induction heating.

What is claimed is:

1. Apparatus for heating a metallic strand using molten metal as the heat transfer medium, the apparatus comprising a tube through which, in use, the strand is passed and which, in use, is filled with molten metal, a container located at each end of the tube for holding a reserve of molten metal for supply to the tube, each container being capable of holding a reserve of molten metal at a level above the level of the tube and means for heating the external wall of the tube.

2. Apparatus as claimed in claim 1 in which an idler roll is located in each container, the strand, in use, passing around one roll on entry to the tube and around the other roll on exit from the tube.

3. Apparatus as claimed in claim 1 in which the means for heating the external wall of the tube comprises a furnace enclosure through which the tube extends, the containers at each end of the tube being in the form of extensions secured to the walls of the enclosure.

* * * * *